United States Patent [19]

Chirnside

[11] 3,998,068

[45] Dec. 21, 1976

[54] FAN DELAY HUMIDISTAT

[76] Inventor: William Chirnside, 7141 Bay St., St. Petersburg, Fla. 33706

[22] Filed: July 17, 1975

[21] Appl. No.: 596,755

[52] U.S. Cl. ..... 62/186; 62/93
[51] Int. Cl.[2] ..... F25B 41/00; F25D 21/04
[58] Field of Search ..... 62/186, 182, 150, 93

[56] References Cited

UNITED STATES PATENTS

| | | | |
|---|---|---|---|
| 2,959,929 | 11/1960 | McGrath | 62/186 X |
| 3,044,271 | 7/1962 | Gerard | 62/150 |

*Primary Examiner*—William E. Wayner
*Attorney, Agent, or Firm*—Duckworth, Hobby, Orman, Allen & Pettis

[57] ABSTRACT

A humidistat assembly of the type used in combination with an air conditioning unit incorporating an evaporator coil and an evaporator fan driven by an adequate fan motor. A sensing element is connected in direct sensing engagement with a predetermined portion of the evaporator coil wherein a current flow regulator means is disposed in circuit between the fan motor and the portion of the sensing means serving to determine the temperature or other predetermined condition of the evaporator coil. Upon the sensing of the desired predetermined condition, current is either established or prevented from flowing between a source of electrical current and the fan motor itself thereby controlling activation of the fan motor and flow of air over the evaporator coil and from the air conditioning assembly. Accordingly, activation of the evaporator fan is delayed until the evaporator coil has reached a predetermined temperature thereby decreasing the amount of water content of the circulated air.

6 Claims, 2 Drawing Figures

FIG. 1
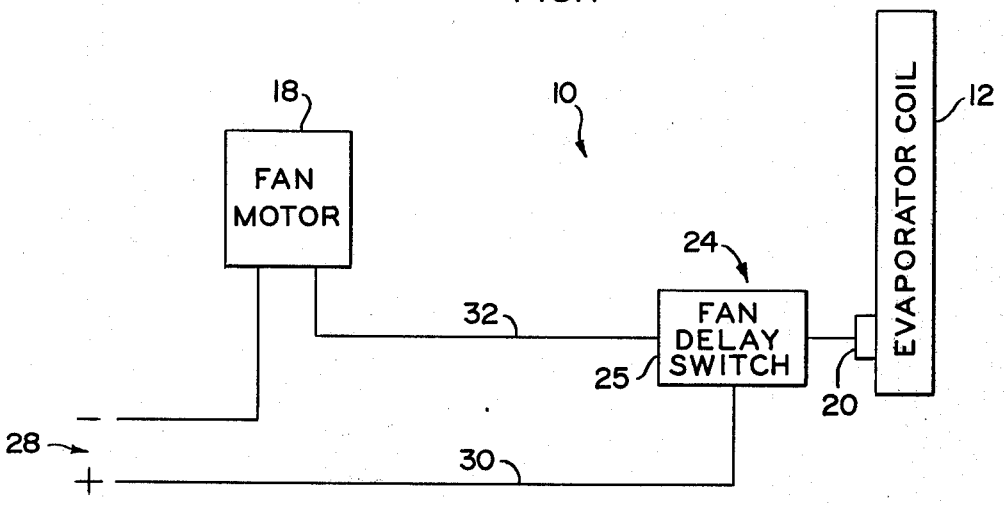
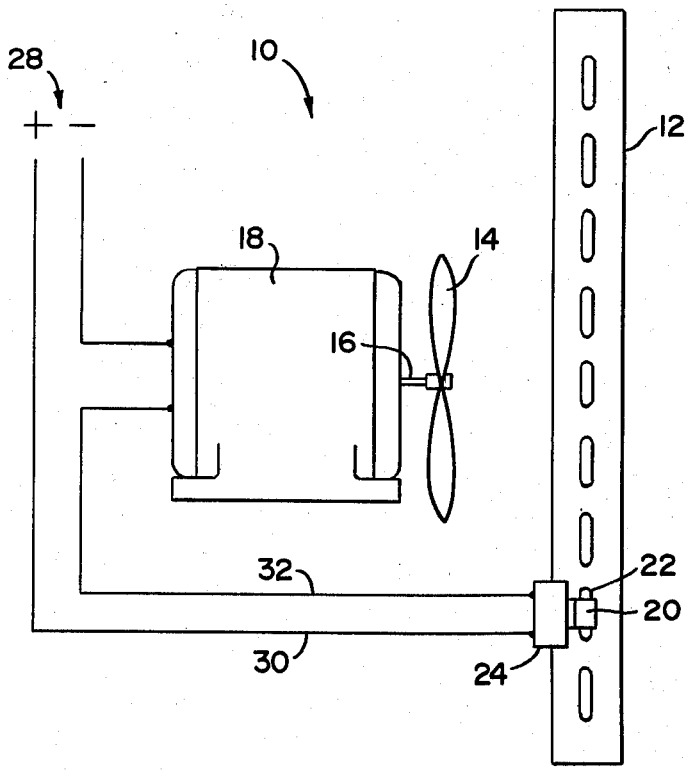
FIG. 2

FAN DELAY HUMIDISTAT

BACKGROUND OF THE INVENTION

1. Field of the Invention

This invention relates to a humidistat used in combination with an air conditioning unit or assembly wherein adequate sensing means are disposed in operative engagement relative to the evaporator coil so as to sense predetermined conditions thereof (temperature) and accordingly, regulate the flow of electrical current to and from the evaporator motor so as to regulate its actuation and the flow of air over the evaporator coil from the air conditioning unit.

2. Description of the Prior Art

Air conditioning systems utilized to regulate temperature within a given enclosure are extremely well known and have been in popular use for many years. While the general public normally associates air conditioning units with the control of temperature, it is also a well accepted fact that numerous air conditioning systems are directed to the control of moisture within a given enclosure.

It is well known that walls, furniture, fixtures and other contents of rooms or enclosures may be damaged by the accumulation of moisture thereon. This accumulation is usually due to an unsatisfactory relation of humidity to temperature occasioned by the room temperature being lower than the temperature of the outside air, for instance, during warm periods such as the summer months. In addition to the damage done to the rooms contents, surface covering, wall paint, etc., it is also well established that relative humidity is an important factor in obtaining sufficient body comfort.

In order to accomplish the desired control of moisture within the conditioned air, various prior art devices have gone to generally complex and overly sophisticated structures in accomplishing proper regulation of humidity within a given enclosure and the proper ratio of humidity to temperature within a given enclosure.

While humidity controlling devices are well known both for use in combination with temperature regulating air conditioning units and also independent of such units, it is generally recognized that such systems are overly complex and accordingly expensive and frequently unreliable both in operation, installation and general operating characteristics.

Prior art systems generally well known in the prior art are represented by the structured disclosed in the following U.S. Pat. Nos.: Freygang, 2,438,120; Erschen, 2,053,771; Palmer, 2,091,562; Bailey, 2,110,693; and Maddox, 3,651,864. While the systems disclosed in the aforementioned U.S. patents are certainly operable and even desirable for certain applications, these systems may be considered overly complex from a structural and design standpoint, especially when concerned with the modification of existing air conditioning units or systems.

Due to the wide acceptability of temperature regulating systems, there is a need in the air conditioning industry to modify existing systems so that the humidity within a given enclosure can be regulated efficiently and reliably. Therefore, there is an obvious need for a dehumidifying system constructed and arranged to automatically affect dehumidification of air within a room or enclosure in a manner to establish an optimum satisfactory relationship of humidity to temperature.

Ideally, such systems should be capable of inexpensive installation and operation and should be adaptable to be used in combination with existing temperature regulating air conditioning units.

SUMMARY OF THE INVENTION

This invention relates to a humidistat assembly of the type used in combination with temperature regulating air condition systems incorporating a substantially conventional evaporator coil and a motor operated fan disposed in fluid communication with the evaporator coil and positioned to direct fluid flow over the evaporator coil and into the predetermined enclosure, or ducting system associated with the air conditioning casing.

The motor used to operate or drive the fan element may be a conventional electric motor powered by a source of electric current.

A sensing means is mounted in direct physical engagement with the evaporator coil so as to sense the temperature thereof. In one embodiment of the present invention, such sensing means can comprise a theremostat used to determine a predetermined temperature of the evaporator coil. In this particular embodiment the thermostat may also include or be operatively connected to a current regulating means as a part thereof. Proper circuitry is utilized to establish flow of current from the source of electrical current, through the flow regulating means and to the electrical motor serving to activate or operate the fan element. Interaction, through proper interconnection of the thermostat and current regulating serves to establish or prohibit current flow between the supply of electrical current in the fan motor by allowing control of the electric motor and result in operation of the fan.

Yet another embodiment of the present invention comprises a pressure sensing means connected in operative engagement to the evaporator coil in such a manner that regulation of a predetermined pressure serves to establish the temperature of the coil and accordingly will cause the desired activation of the current regulating means and thereby establish or prohibit current flow between the electrical current source and the fan motor.

Alternately, a dely switch may be disposed in circuitry between the sensing means and the motor whereby the fan delay switch is delayed a predetermined time (60–90 seconds) dependent upon the operating characteristics of the entire unit desired by the design or dependent upon the specific operating characteristics desired.

In the preferred embodiment of the present invention, a sensing means is designed ideally to determine a temperature of 30° F. (+ or − 2° F.) of the evaporator coil. The combination of the interacting and cooperatively associated sensing means and current regulating means allows the current regulating means to "close" thereby allowing adequate current flow between the source of supply current from the fan motor itself. This of course, in turn allows operation of the fan element and directs a flow of air or fluid over the evaporating coil and into the enclosure being conditioned. Delay of fan operation in this manner or until the evaporator coil reaches the predetermined point allows additional condensate run-off prior to the forced air flow over the evaporator coil and out into the enclosed space being conditioned. Upon the temperature of the air conditioned space reaching a desired low temperature the entire air condition unit will shut off if it is operating on automatic mode. The sensing mode and/or current regulating means will then be automatically reset to delay operation of the fan motor once the compressor unit is again activated, until the evaporator coil reaches a temperature of 30° F. Delay of the fan activation to a point of approximately 30° F. prevents the condensate normally accumulated on the coil from passing out through the force flow of air or fluid as it passes over the coils. At a temperature range of 30°, the condensate will essentially be solidified with the process of solidification prior to the flow of fluid from the fan.

Again, alternate embodiments of the present invention may incorporate the sensing means being in the form of a pressure sensor rather than direct temperature sensor and/or the current regulating means made in the form of a time delay switch. In any event, temperature of the evaporator coil and prompt regulation of current flow to the fan motor is established.

It should be well recognized that the sensing means can be preset or predetermined to activate the fluid regulating means for any desired temperature, pressure or measurable characteristics of operation to determine proper temperature of the evaporator coil.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a schematic of the humidistat assembly used in combination with an evaporator coil and fan motor of an air conditioning assembly wherein the current regulating means comprises a fan delay switch.

FIG. 2 is a schematic showing the fan motor, fan element, sensing means and current regulating means in combination with an evaporator coil of an air conditioning assembly.

Similar reference characters refer to similar parts through the several view of the drawings.

DETAILED DESCRIPTION

As shown in FIGS. 1 and 2, this invention is directed to a humidistat assembly used in combination with an air conditioning structure wherein the entire system is generally indicated as 10. More particularly, an evaporator coil 12 is disposed in conventional placement in an air conditioning unit so as to cool fluid or air issuing from the unit as it passes into a defined enclosure (not shown). A fan element 14 is drivingly connected by proper shafting 16 to an electric motor 18 used independently of other functions to drive the fan element 14 and thereby direct air or fluid over the evaporator coil 12.

The present invention further comprises a sensing means 20 disposed in direct sensing engagement with a portion of the evaporator coil 12. More specifically, the sensing means 20 may be in direct engagement with a fin or either a substantially conventional U-shaped return portion of the coil 22.

As shown primarily in FIG. 2, the sensing means 20 is electrically or operatively connected to a current regulating means 24 which is disposed in circuit between electric fan motor 18 and a source of electric current generally indicated as 28. The supply of electric current 28 may be any applicable source dependent upon the particular application and operational characteristics of the humidistat and air conditioning assembly and may further comprises a standard residential 120 volt outlet.

Proper electrical conductors 30 and 32 arrange the current regulator 24 in series with the electric motor 18 whereby upon controlled activation by the sensing means 20, the current regulator means 24 serves to either prohibit or allow current to pass from the supply 28 to the electric motor 18 thereby controlling activation of the fan element 14 and forcing of the fluid over the evaporator coil 12 for cooling of the predetermined enclosure.

In one embodiment of the present invention the sensing means 20 may be a thermostat device clamped, or otherwise applicably attached to a predetermined portion of the evaporator coil 12 as set forth above. In the preferred or ideal circumstances, the thermostat comprising the sensing means 20 may be set to "close" the current regulator 24 upon reaching substantially 30° F. (+ or − 2°). Upon reaching this preset temperature the circuit is completed between the supply 28 and the electric motor 18 thereby causing operation of fan 14 and the passing of air or fluid over the evaporator coil 12. At this temperature, fluid flow over the evaporator coil occurs after considerable moisture passes out through drains off the evaporator coil. Accordingly, further, at this temperature certain condensate has begun to form on the coils themselves thereby reducing the actual moisture content of the air passing from the coils into the defined enclosure receiving the conditioned air. The sensing device 20 comprising the thermostat may be set at its "upper end" at approximately 60°–65° wherein the current regulator 24 "opens" thereby stopping current to the electric motor and deactivating the fan element 14. This of course stops fluid flow over the evaporator coil and prevents flow of air through the coil into the conditioned space.

It should be noted that various other sensing means 20 may be incorporated other than a thermostat. For instance, since it is well recognized that pressure, temperature and volume are all related in a pressurized system, the sensing means 20 can be a pressure sensing device wherein certain pressures will indicate that the coil has reached a predetermined temperature for proper activation or deactivation of the motor 18.

Yet another embodiment of the present invention comprises the current regulator means 24 including a fan delay switch 25 wherein indication from the sensing means 20 and/or direct engagement with the evaporator coil 12 causes a delay of 60–90 seconds, preferably, before current is fed to the fan motor 18 from the supply 28. Again, in this manner the fan motor is delayed before operation or activation thereby in turn delaying passage of fluid flow (air) over the evaporator coil until most of the condensate has been drained from the coil.

It will thus be seen that the objects made apparent from the preceding description are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A humidistat assembly primarily designed for use in combination with an air conditioning assembly to delay operation of an evaporator fan, said air conditioning assembly incorporating an evaporator coil means, fan means disposed in fluid communication with said evaporator coil means, motor means drivingly connected to said fan means, whereby air is circulated through said evaporator coil means and forced to exit from said air conditioning assembly upon activation of said motor means and operation of said fan means; said humidistat assembly further comprising sensing means mounted in direct engagement with said evaporator coil means, electrical current flow regulating means electrically connected to said sensing means and disposed in current conductive and regulating relation between said fan means and a supply of electric current connected to said motor means, said regulating means comprising switch means movable between an open and closed position and operatively interconnected to said sensing means, said sensing means being preset to close said switch means at a predetermined low temperature near 32° F and to open said switch means at a predetermined higher temperature above 32° F thereby providing fan delay operation allowing condensate run off prior to forced air flow over the evaporator.

2. A humidistat assembly as in claim 1 wherein said sensing means comprises a temperature sensing element disposed in direct engagement with said evaporator coil means.

3. A humidistat assembly as in claim 2 wherein said temperature sensing element is mounted on said evaporator coil means in direct contact with a U-shpaed return coil portion thereof.

4. A humidistat assembly as in claim 1 wherein said sensing device comprises a pressure sensitive element mounted in direct engagement with said evaporator coil means and in electrically conductive relation to said current flow regulating means.

5. A humidistat assembly as in claim 1 wherein said current flow regulating comprises an electrically operative time delay switch electrically connected to said sensing means, said time delay switch movable between an open and closed position, whereby current flows to said motor means and is regulated.

6. A humidistat assembly as in claim 1 wherein said sensing means is preset to activate said current regulating means upon determination of temperature of said evaporator coil between 28° F. and 32° F.

* * * * *